US007998886B2

(12) United States Patent
Li et al.

(10) Patent No.: US 7,998,886 B2
(45) Date of Patent: Aug. 16, 2011

(54) HINDERED AMINE TREATED TEXTILES

(75) Inventors: Shulong Li, Spartanburg, SC (US); Ling Li, Spartanburg, SC (US)

(73) Assignee: Milliken & Company, Spartanburg, SC (US)

( * ) Notice: Subject to any disclaimer, the term of this patent is extended or adjusted under 35 U.S.C. 154(b) by 1110 days.

(21) Appl. No.: 11/256,887

(22) Filed: Oct. 24, 2005

(65) Prior Publication Data

US 2007/0092724 A1 Apr. 26, 2007

(51) Int. Cl.
*B32B 27/18* (2006.01)
*B32B 33/00* (2006.01)
*B32B 25/02* (2006.01)

(52) U.S. Cl. ..... 442/123; 442/59; 442/62; 428/296.4; 428/375

(58) Field of Classification Search ..... 8/189; 252/8.84, 252/8.86; 427/214, 257; 428/296.4, 375, 428/394; 508/225, 542; 523/435; 524/87; 525/124
See application file for complete search history.

(56) References Cited

U.S. PATENT DOCUMENTS

| | | | | |
|---|---|---|---|---|
| 3,488,701 | A | 1/1970 | Herbes et al. | |
| 4,016,168 | A * | 4/1977 | Murayama et al. | 546/17 |
| 4,780,230 | A * | 10/1988 | Liu et al. | 508/259 |
| 4,931,562 | A * | 6/1990 | Akabane et al. | 546/19 |
| 5,057,562 | A * | 10/1991 | Reinert | 524/87 |
| 5,490,983 | A | 2/1996 | Worley et al. | |
| 5,670,646 | A | 9/1997 | Worley et al. | |
| 5,705,545 | A | 1/1998 | Avar et al. | |
| 5,817,806 | A | 10/1998 | Rossi et al. | |
| 5,882,357 | A * | 3/1999 | Sun et al. | 8/189 |
| 5,889,130 | A | 3/1999 | Worley et al. | |
| 5,902,818 | A | 5/1999 | Worley et al. | |
| 6,020,491 | A | 2/2000 | Worley et al. | |
| 6,077,319 | A | 6/2000 | Sun et al. | |
| 6,162,452 | A | 12/2000 | Worley et al. | |
| 6,172,232 | B1 * | 1/2001 | Stahrfeldt | 546/155 |
| 6,241,783 | B1 | 6/2001 | Sun | |
| 6,265,576 | B1 * | 7/2001 | Gupta et al. | 544/216 |
| 6,294,185 | B1 | 9/2001 | Worley et al. | |
| 6,482,756 | B2 * | 11/2002 | Li | 442/123 |
| 6,576,154 | B1 | 6/2003 | Li | |
| 6,585,989 | B2 | 7/2003 | Herbst et al. | |
| 6,632,860 | B1 * | 10/2003 | Hansen et al. | 523/435 |
| 6,770,287 | B1 | 8/2004 | Sun et al. | |
| 2003/0056297 | A1 | 3/2003 | Sun | |
| 2003/0064645 | A1 | 4/2003 | Worley et al. | |
| 2003/0198796 | A1 * | 10/2003 | Rische et al. | 428/296.4 |
| 2004/0063831 | A1 | 4/2004 | Sheppard et al. | |
| 2004/0086480 | A1 | 5/2004 | Worley et al. | |
| 2004/0121682 | A1 | 6/2004 | Quincy et al. | |
| 2004/0127667 | A1 | 7/2004 | Worley et al. | |
| 2004/0191315 | A1 | 9/2004 | Slattery et al. | |
| 2004/0192813 | A1 * | 9/2004 | Pearson et al. | 524/115 |
| 2006/0148940 | A1 | 7/2006 | Sun et al. | |

FOREIGN PATENT DOCUMENTS

| | | | |
|---|---|---|---|
| AU | 18 700 70 | * | 8/1970 |
| EP | 0 352 221 | A1 | 1/1990 |
| RU | 2030497 | C1 * | 3/1995 |
| WO | WO 01/07550 | A1 | 2/2001 |
| WO | WO 0107550 | A1 * | 2/2001 |
| WO | WO 2005/058814 | A2 | 6/2005 |

OTHER PUBLICATIONS

CAS # 82451-48-7, online posting by chemblink online Database of Chemcals.*
Eknoian, M.W. et al. *Polymer* 1999, 40, 1367-71.
Qian, L. et al. *J. Appl. Polym. Sci.* 2004, 91, 2588-93.
SciFinder Search Results for 1-chloro-2,2,6,6-tetramethyl-4-piperidinyl structures (2006).
Chen et al., Antimicrobial Functions of N-Chloro-Hindered Amines, *Polymer Preprints*, 46(2): 835-836 (2005).
Chen et al., N-Chloro-Hindered Amines as Multifunctional Polymer Additives, *Macromolecules*, 38: 8116-8119 (2005).
Sun et al., The Chemistry of Functional Finishing: Self-decontaminating Textile Materials, *National Textile Center Research Briefs —Chemistry Competency* (Jun. 2003).
Sun et al., Chemistry of Functional Finishing: Self-decontaminating Textile Materials,*National Textile Center Research Briefs —Chemistry Competency* (Jun. 2004).
Sun et al., Chemistry of Functional Finishing: Self-decontaminating Textile Materials, *National Textile Center Research Briefs —Chemistry Competency* (Jun. 2005).
Sun et al., Synthesis, Characterization, and Antibacterial Activities of Novel *N*-Halamine Polymer Beads Prepared by Suspension Copolymerization, *Macromolecules*, 35: 8909-8912 (2002).
Sun et al., National Center Annual Report, NTC Project CO2-CD06 (Nov. 2003).
Sun et al., National Center Annual Report, NTC Project CO2-CD06 (Nov. 2004).

* cited by examiner

*Primary Examiner* — Angela Ortiz
*Assistant Examiner* — Jennifer Steele
(74) *Attorney, Agent, or Firm* — Robert M. Lanning

(57) ABSTRACT

A treated textile material comprises a plurality of yarns or fibers having a hindered amine or halamine compound disposed on the exterior surface of the yarns or fibers and/or dispersed in the interior portion of the yarns or fibers. A treated textile material comprises a finish on a surface thereof, the finish comprising the product of a reaction between a cross-linking agent and a polymer comprising a plurality of secondary, hindered amine moieties attached to the polymer chain. Methods for making the treated textile materials are also described.

10 Claims, No Drawings

HINDERED AMINE TREATED TEXTILES

FIELD OF THE INVENTION

The invention is directed to antimicrobial materials and articles treated with antimicrobial materials, such as textile materials treated with a compound or compounds exhibiting antimicrobial properties.

BRIEF SUMMARY OF THE INVENTION

In a first embodiment, the invention provides a treated textile material comprising a plurality of yarns, the yarns comprising a hindered amine or halamine compound disposed on the exterior surface of the yarns and/or dispersed in the interior portion of the yarns.

In a first method embodiment, the invention also provides a method for treating a textile material comprising the steps of (a) providing a textile material comprising a plurality of yarns, the yarns having an exterior surface and an interior portion, and (b) immersing at least a portion of the textile material in a composition comprising a hindered amine or halamine compound for a time and under conditions sufficient for the hindered amine or halamine compound to deposit onto the exterior surface of the yarns and/or penetrate into the interior portion of the yarns.

In a second embodiment, the invention further provides a treated textile material comprising a finish on a surface thereof, the finishing comprising a product of a reaction between a cross-linking agent and a polymer. The polymer comprises a polymer chain and a plurality of secondary, hindered amine moieties attached to the polymer chain.

In a second method embodiment, the invention also provides a method for treating a textile material comprising the steps of (a) providing a textile material having at least one surface to be treated, (b) contacting at least a portion of the surface of the textile material with a polymer comprising a polymer chain and a plurality of secondary, hindered amine moieties attached to the polymer chain to deposit the polymer on the contacted portion of the surface, and (c) reacting the polymer deposited on the surface of the textile material in step (b) with a cross-linking agent to cross-link the polymer.

DETAILED DESCRIPTION OF THE INVENTION

In a first embodiment, the invention provides a treated textile material comprising a plurality of yarns, the yarns comprising a hindered amine or halamine compound disposed on the exterior surface of the yarns and/or dispersed in the interior portion of the yarns.

The treated textile material of the invention can be any suitable textile material. The textile material can comprise a plurality of yarns provided in a knit or woven construction, or the textile material can comprise a plurality of fibers that are provided in a non-woven construction. The yarns or fibers from which the textile material is constructed can contain natural fibers, synthetic fibers, or any suitable combination thereof. Suitable fibers include, but are not limited to, cellulose (e.g., cotton and rayon), polyamides, polyesters, polyethylenes, polypropylenes, polyacrylics, cellulose acetate, polylactic acid, silk, wool, glass, polyaramids, and combinations thereof. In a preferred embodiment, the textile material comprises yarns comprising fibers selected from the group consisting of cellulose fibers (e.g., cotton and rayon), polyester fibers, and combinations thereof (e.g., blends of cotton and polyester fibers).

The hindered amine compound can be any suitable secondary hindered amine compound (i.e., a hindered amine compound having a hydrogen atom bonded to the nitrogen atom of the amine group). As utilized herein, the term "hindered amine" refers to a compound or moiety in which the carbon atoms adjacent to the nitrogen atom of the amine group do not have a hydrogen atom attached directly thereto. Preferably, the carbon atoms adjacent to the nitrogen atom of the hindered amine compound or moiety are not carbonyl carbons (i.e., a carbon atom having an oxygen atom double bonded thereto). As utilized herein, the term "halamine" refers to an amine derivative (e.g., a derivative of a secondary amine) in which a hydrogen attached to the nitrogen atom of the amine has been replaced with a halogen atom (e.g., a chlorine atom). The hindered amine or halamine compound can have any suitable molecular weight. Typically, the hindered amine or halamine compound has a molecular weight of about 2,500 atomic mass units or less, preferably about 2,000 atomic mass units or less, or about 1,000 atomic mass units or less, or about 500 atomic mass units or less.

In certain embodiments, the hindered amine or halamine compound conforms to structure (I)

(I)

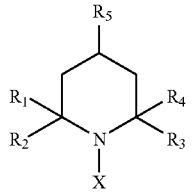

In structure (I), $R_1$, $R_2$, $R_3$, and $R_4$ are independently selected from the group consisting of $C_1$-$C_4$ alkyl groups, and $R_5$ is selected from the group consisting of a hydrogen atom, an alkyl group, an alkyl amine group, a cyclic amine group, an amide group, a cyclic amide group, an isocyanate group, a hydroxyl group, an ether group, an ester group, and combinations thereof. X represents a hydrogen atom, a chlorine atom, a bromine atom, or an iodine atom.

Suitable hindered amine or halamine compounds conforming to structure (I) include, but are not limited to, 2,2,6,6-tetramethylpiperidine (CAS Registry Number 768-66-1), 4-chloro-2,2,6,6-tetramethylpiperidine, 4-bromo-2,2,6,6-tetramethylpiperidine (CAS Registry Number 67845-89-0), 2,2,6,6-tetramethyl-piperidin-4-ol, 4-isocyanato-2,2,6,6-tetramethylpiperidine (CAS Registry Number 84712-82-3), N-butyl-2,2,6,6-tetramethylpiperidin-4-amine (CAS Registry Number 36177-92-1), 4,4-bis[(tert-butyl)dioxy]-2,2,6,6-tetramethylpiperidine (CAS Registry Number 75279-29-7), N,N-bis-(2,2,6,6-tetramethyl-piperidin -4-yl) -propane-1,3-diamine (CAS Registry Number 63525-94-0), N,N-bis-(2,2,6,6-tetramethyl-piperidin-4-yl)-hexane-1,6-diamine (CAS Registry Number 61260-55-7), $N^1$-(2,2,6,6-tetramethyl-piperidin-4-yl) -hexane-1,6-diamine (CAS Registry Number 72245-37-5), 2,2,6,6-tetramethylpiperidin-4-yl benzoate (CAS Registry Number 26275-88-7), bis(2,2,6,6-tetramethyl-4-piperidyl) succinate (CAS Registry Number 62782-03-0), 3-dodecyl-1-(2,2,6,6-tetramethyl-piperidin-4-yl)-pyrrolidine-2,5-dione (CAS Registry Number 79720-19-7), 1,5-dioxa-spiro[5.5]undecane-3,3-dicarboxylic acid bis-(2,2,6,6-tetramethyl-piperidin-4-yl)ester (CAS Registry Number 110843-97-5), 2,6-bis-(2,2,6,6-tetramethyl-piperidin-4-yl)-hexahydro-2,3a ,4a,6,7a,8a-hexaaza-cyclopenta[delfluorine-4,8-dione (CAS Registry Number 109423-00-9), N,N'-bis(2, 2,6,6-tetramethylpiperidin-4-yl)-N,N'-diformyl-1,6-diaminohexane (CAS Registry Number 124172-53-8), 2,2,6,6-tetramethyl-4-piperidinecarboxylic acid 1,4-cyclohexanediylbis(methylene)ester (CAS Registry Number 70851-59-1), 2,2,6,6-tetramethyl-piperidin-4-yl methacrylate (CAS Registry Number 31582-45-3), methyl-[3-(2,2,6,6-tetramethyl-piperidin-4-yloxy)-propyl]-silanediol (CAS Registry Number 164578-16-9), N-(2,2,6,6-tetramethyl-piperidin-4-yl)stearamide (CAS Registry Number 37819-84-4), bis(2,2,6,6-tetramethyl-piperidin-4-yl)sebacate (CAS Registry Number 52829-07-9), bis(1,2,2,6,6-pentamethyl-piperidin-4-yl)sebacate (CAS Registry Number 41556-26-7), methyl 1,2,2,6,6-pentamethyl-piperidin -4-yl sebacate (CAS Registry Number 82919-37-7), 4-hydroxy-2,2,6,6-tetramethyl-piperidine-4-carboxylic acid (CAS Registry Number 65402-65-5), heptadecanoic acid 2,2,6,6-tetramethyl-piperidin-4-yl ester, N,N'-1,6-hexanediylbis[N-(2,2,6,6-tetramethyl-piperidin-4-yl)-formamide (CAS Registry Number 124172-53-8), N,N'-bis(1,1,3,3-tetramethylbutyl) -2,9,15,22-tetrakis(2,2,6,6-tetramethyl-piperidin-4-yl)-2,9,11,13,15,22,24,26,27,28-decaazatricyclo[21.3.1.1$^{10,14}$]octacosa-1(27),10,12,14(28),23,25-hexaene-12,25-diamine (CAS Registry Number 86168-95-8), poly[(6-morpholino-s-triazine-2,4-diyl)[(2,2,6,6-tetramethyl-piperidin -4-yl)imino]-hexamethylene[(2,2,6,6-tetramethyl-piperidin-4-yl)imino)]] (CAS Registry Number 082451-48-7), and combinations thereof. Suitable hindered amine or halamine compounds conforming to structure (I) also include those hindered amine or halamine compounds conforming to structure (VI)

(VI)

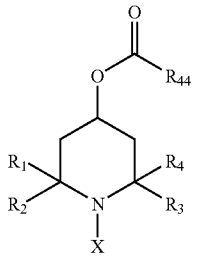

In structure (VI), $R_1$, $R_2$, $R_3$, and $R_4$ are independently selected from the group consisting of $C_1$-$C_4$ alkyl groups, and $R_{44}$ is a $C_{11}$-$C_{20}$ alkyl group. Also, X represents a hydrogen atom, chlorine atom, bromine atom, or iodine atom. A particular embodiment of a hindered amine compound conforming to structure (VI) is a hindered amine light stabilizer sold under the name CYASORB® UV-3853 (available from Cytec Industries Inc.) (CAS Registry Number 167078-06-0), in which $C_1$-$C_4$ are methyl groups and the $R_{44}$ groups are $C_{11}$-$C_{20}$ alkyl groups, predominantly $C_{16}$-$C_{18}$ alkyl groups. When the hindered amine compound conforms to structure (i), the hindered amine compound preferably is poly[(6-morpholino-s-triazine-2,4-diyl)[(2,2,6,6-tetramethyl-piperidin-4-yl) imino]-hexamethylene[(2,2,6,6-tetramethyl-piperidin-4-yl) imino)]] (CAS Registry Number 082451-48-7).

In certain embodiments, the hindered amine or halamine compound conforms to structure (II)

(II)

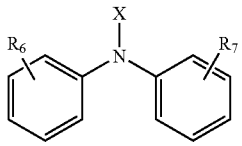

In structure (II), $R_6$ and $R_7$ are independently selected from the group consisting of a hydrogen atom, an alkyl group, an aryl group, an amine group, an amide group, and combinations thereof. X represents a hydrogen atom, a chlorine atom, a bromine atom, or an iodine atom. Suitable hindered amine or halamine compounds conforming to structure (II) include, but are not limited to, N-phenylnaphthalen-1-amine, N-phenylnaphthalen-2-amine, bis-[4-(1-phenyl-ethyl)-phenyl]-amine, N-(1,3-dimethylbutyl)-N'-phenylbenzene-1,4-diamine, 4-methylphenyl(4-anilinophenyl)amidosulfite, and combinations thereof.

In certain embodiments, the hindered amine or halamine compound conforms to structure (III)

(III)

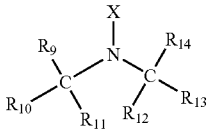

In structure (III), $R_9$, $R_{11}$, $R_{12}$, and $R_{14}$ are independently selected from the group consisting of $C_1$-$C_4$ alkyl groups, and $R_{10}$ and $R_{13}$ are independently selected from the group consisting of an alkyl group, an aryl group, an amine group, an amide group, and combinations thereof. X represents a hydrogen atom, a chlorine atom, a bromine atom, or an iodine atom.

In certain embodiments, the hindered amine or halamine compound conforms to structure (IV)

(IV)

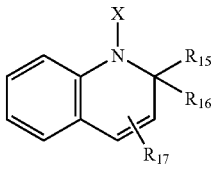

In structure (IV), $R_{15}$ and $R_{16}$ are independently selected from the group consisting of $C_1$-$C_4$ alkyl groups, and $R_{17}$ is selected from the group consisting of a hydrogen atom, an alkyl group, an aryl group, an amine group, an amide group, and combinations thereof. X represents a hydrogen atom, a chlorine atom, a bromine atom, or an iodine atom.

In certain embodiments, the hindered amine or halamine compound conforms to structure (V)

(V)

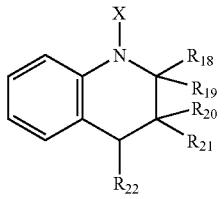

In structure (V), $R_{18}$, $R_{19}$, $R_{20}$, and $R_{21}$ are independently selected from the group consisting of $C_1$-$C_4$ alkyl groups, and $R_{22}$ is selected from the group consisting of a hydrogen atom, an alkyl group, an aryl group, an amine group, an amide group, and combinations thereof. X represents a hydrogen atom, a chlorine atom, a bromine atom, or an iodine atom. Suitable hindered amine or halamine compounds conforming to structures (IV) and (V) include, but are not limited to, 2,2-dimethyl-1,2-dihydroquinoline, 2,2,4-trimethyl-1,2-dihydroquinoline, 2,2,3,3-tetramethyl-1,2,3,4-tetrahydroquinoline, 2,2,3,3,4-pentamethyl-1,2,3,4-tetrahydroquinoline, and combinations thereof.

The treated textile material according to the invention can comprise any suitable amount of the hindered amine or halamine compound(s). Typically, the hindered amine or halamine compound(s) are present in the treated textile material in an amount such that textile material exhibits antimicrobial properties or can be made to exhibit antimicrobial properties, for example, by contacting the textile material with an aqueous hypohalite solution. For example, when the hindered amine compound conforms to one of structures (I)-(VI) in which X is hydrogen, the hindered amine typically is present in such an amount that the textile material is rendered antimicrobial after it has been exposed to an aqueous solution of a hypohalite (e.g., an aqueous hypochlorite-containing solution containing about 0.001 to about 1% by weight of a hypochlorite, such as sodium hypochlorite) or other dilute oxidative halogenated solutions. As utilized herein, the term "oxidative halogen solution" refers to a solution containing a halogen-containing species in which the halogen is in an oxidative valent state (i.e., a zero or positive valence state). Suitable oxidative halogen solutions include, but are not limited to, solutions of sodium hypochlorite, potassium hypobromite, chlorine oxide, sodium periodate, iodine, bromine, and combinations thereof. The oxidative halogen solution can be applied to the treated textile material by any suitable method. For example, the oxidative halogen solution can be added to the rinse liquid used in a typical laundering process, or the oxidative halogen solution can be sprayed and/or wiped onto the surface of the textile material.

While not wishing to be bound to any particular theory, it is believed that at least a portion of the hindered amine compounds present on the treated textile material undergo a reaction with the halogen-containing species in the oxidative halogen solution in which the species reacts with the nitrogen atom of the hindered amine compound to replace the hydrogen with a halogen atom, thereby producing a halamine. For example, upon exposure to a hypohalite solution, such a hindered amine compound (i.e., a compound conforming to one of structures (I)-(VI) in which X is hydrogen) is believed to undergo an equilibrium reaction in which a protonated hypohalite ion reacts with the nitrogen atom of the hindered amine to replace the hydrogen atom with a halogen atom and eliminate water. Such a reaction using an aqueous hypochlorite solution can be represented by the following general reaction scheme:

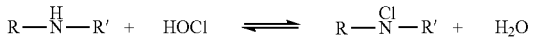

Typically, the hindered amine or halamine compound is present in the treated textile material in an amount of about 1 wt. % or more, based on the total weight of the treated textile material. The hindered amine or halamine compound can be present on the surface of the textile material itself (e.g., as a finish on the surface of the textile material), on the surface of the yarns from which the textile material is made, and/or dispersed within the fibers or yarns from which the textile material is made. In such embodiments, the hindered amine or halamine compound typically is present in an amount of about 10 wt. % or less, or about 5 wt. % or less, based on the total weight of the treated textile material. Preferably, the hindered amine or halamine compound is present in an amount of about 2 to about 5 wt. %, based on the total weight of the treated textile material, to provide sufficient antimicrobial properties after repeated laundering of the textile material.

The treated textile material of the first embodiment can be produced by any suitable method. For example, the hindered amine or halamine compound can be applied to the surface of the textile material using a foam application method, in which the hindered amine or halamine compound is carried by a foam composition that is applied to a surface of the textile material to be treated. The treated textile material can also be produced by treating a package of yarn(s) with a hindered amine or halamine compound. The textile material can then be formed from the treated yarn(s) using conventional textile manufacturing processes. The treated textile material can also be produced by treating a textile material using conventional spray, dip coating, or impregnation processes. The processes can employ one or more of elevated temperatures, fiber swelling solvents, dye carriers, plasticizers, steam (e.g., both atmospheric steam and super-heated steam), infrared radiation, sonication, supercritical fluids (e.g., supercritical carbon dioxide), etc. Typically, elevated temperatures (e.g., temperatures of about 100 to about 200° C.) and/or steam are used in treating the textile material. When the hindered amine or halamine compound is applied using a foam application, spray, dip coating, or impregnation process, the treated fabric typically is dried in an oven at a temperature of about 150 to about 200° C. for about 30 seconds to about 10 minutes.

Alternatively, in a first method embodiment, the treated textile material can be produced by a method comprising the steps of (a) providing a textile material comprising a plurality of yarns, the yarns having an exterior surface and an interior portion, and (b) immersing at least a portion of the textile material in a composition comprising a hindered amine or halamine compound for a time and under conditions sufficient for the hindered amine or halamine compound to deposit onto the exterior surface of the yarns and/or penetrate into the interior portion of the yarns.

The textile materials suitable for treatment using the first method embodiment described above can be any suitable textile materials, including those textile materials described above as being suitable for the first embodiment of the treated textile material.

The composition used to carry the hindered amine compound can be any suitable composition. For example, the hindered amine or halamine compound can be dissolved or suspended in an organic solvent. Alternatively, the hindered amine or halamine compound can be emulsified or dispersed in an aqueous carrier using an appropriate emulsifying or dispersing agent. Typically, such emulsions or dispersions are produced by subjecting a mixture of the hindered amine or halamine compound, the emulsifying or dispersing agent, and an aqueous carrier to a high shear or milling process. Preferably, the hindered amine or halamine compound is dissolved in an acidic aqueous solution at a concentration of about 5 to about 60 wt. %, based on the total weight of the acidic aqueous solution. The acidic aqueous solution utilized in making the composition of the method can contain any suitable acid. Preferably, the acidic aqueous solution contains a volatile acid, such as acetic acid, propionic acid, or hydrogen chloride. While not wishing to be bound to any particular theory, it is believed that the use of a volatile acid will allow the acid to be removed when the treated textile material is dried following application of the composition. The acid can be added to the aqueous solution in any suitable amount. Typically, the amount of acid is an amount sufficient to dissolve the hindered amine or halamine compound in the aqueous solution. The molar ratio acid to hindered amine moieties typically is greater than about 1.

The textile material to be treated can be immersed in the composition using any suitable apparatus. For example, the textile material can be treated using a typical piece dyeing apparatus, such as a jet-dyeing machine. In this method embodiment, the textile material to be treated typically is immersed in the composition at an elevated temperature of about 100 to about 130° C. for time of about 5 to about 60 minutes.

In a second embodiment, the invention provides a treated textile material comprising a finish on a surface thereof. The finish comprises a product of a reaction between a cross-linking agent and a polymer comprising a plurality of secondary, hindered amine moieties attached to the polymer chain. The treated textile material of the invention can be any suitable textile material, including, but not limited to, those described above as being suitable for the first embodiment of the treated textile material.

The cross-linking agent utilized in the second embodiment of the treated textile material can be any suitable cross-linking agent. Preferably, the cross-linking agent is capable of reacting with the secondary hindered amine moieties present on the polymer. Suitable cross-linking agents include, but are not limited to, aliphatic isocyanates (blocked or unblocked aliphatic isocyanates), aromatic isocyanates (blocked or unblocked aromatic isocyanates), epoxy resins, melamine formaldehyde resins, urea formaldehyde resins, polycarbodiimide resins, aziridines, azetidium, chloro-triazines, and combinations thereof. Preferably, the cross-linking agent comprises more than two reactive groups per molecule. Suitable isocyanate cross-linking agents include, but are not limited to, methyl ethyl ketoxime blocked isocyanates, such as methyl ethyl ketoxime blocked 4,4'-diphenylmethane diisocyanate, methyl ethyl ketoxime blocked hexamethylenediisocyanate, oligomers and polymers thereof.

The polymer utilized in the second embodiment of the treated textile material can be any suitable polymer comprising a plurality of (e.g., at least two, preferably at least three) secondary hindered amines attached to the polymer chain or polymer backbone. As utilized herein, the term "polymer" is used to describe any backbone structure, such as linear, branched, or cyclic chain structures, comprising a plurality of (e.g., at least two, preferably at least three) secondary hindered amine moieties covalently bonded to the backbone structure. While not wishing to be bound to any particular theory, it is believed that a polymer comprising a greater number of secondary hindered amine moieties will exhibit a higher cross-linking density and, therefore, form a more durable finish on the textile material. Accordingly, the polymer preferably comprises an average of about three or more hindered amine moieties per polymer molecule, or about 3.5 or more hindered amine moieties per polymer molecule, or about 4 or more hindered amine moieties per polymer molecule, or about 4.5 or more hindered amine moieties per polymer molecule, or about 5 or more hindered amine moieties per polymer molecule. The number of hindered amine moieties can also be expressed in terms of millimoles of hindered amine moieties per gram of polymer solid. Preferably, the polymer comprises about 1 or more millimoles of hindered amine moieties per gram of polymer solid, or about 1.5 or more millimoles of hindered amine moieties per gram of polymer solid, or about 2 or more millimoles of hindered amine moieties per gram of polymer solid, of about 2.5 or more millimoles of hindered amine moieties per gram of polymer solid, or about 3 or more millimoles of hindered amine moieties per gram of polymer solid.

In certain embodiments, the polymer comprises secondary, hindered amine moieties conforming to structure (VII)

(VII)

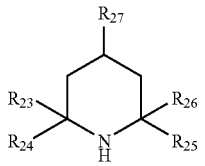

In structure (VII), $R_{23}$, $R_{24}$, $R_{25}$, and $R_{26}$ are independently selected from the group consisting of $C_1$-$C_4$ alkyl groups, and $R_{27}$ is a group linking the hindered amine moiety to the polymer chain. Suitable polymers comprising hindered amine moieties conforming to structure (VII) include, but are not limited to, (i) a copolymer of N,N-bis-(2,2,6,6-tetramethyl-piperidin-4-yl)-propane-1,3-diamine, N,N-bis-(2,2,6,6-tetramethyl-piperidin-4-yl)-hexane-1,6-diamine, and N-butyl-2,2,6,6-tetramethylpiperidin-4-amine (CAS Registry Number 72076-41-6), (ii) a copolymer of N-butyl-2,2,6,6-tetramethylpiperidin-4-amine, $N^1$-(2,2,6,6-tetramethyl-piperidin-4-yl)-hexane-1,6-diamine, and 2,4,6-trichloro-[1,3,5]triazine (CAS Registry Number 72245-38-6), (iii) a copolymer or homopolymer of 2,2,6,6-tetramethyl-piperidin-4-yl methacrylate, (iv) a copolymer of 2,2,6,6,-tetramethyl-piperidin-4-amine, maleic anhydride, and $C_{20}$-$C_{24}$ alkenes (CAS Registry Number 152261-33-1), (v) poly[(6-morpholino-s-triazine-2,4-diyl)[(2,2,6,6-tetramethyl-piperidin -4-yl)imino]-hexamethylene[(2,2,6,6-tetramethyl-piperidin-4-yl) imino)]] (CAS Registry Number 082451-48-7), (vi) a copolymer of N,N-bis-(2,2,6,6-tetramethyl-piperidin-4-yl)-hexane-1,6-diamine, 2,4,6-trichloro-[1,3,5] triazine, and N-butyl-1-butanamine (CAS Registry Number 192268-64-7), (vii) poly[(6-((1,1,3,3-tetramethylbutyl) amino) -1,3,5-triazine-2,4-diyl)((2,2,6,6-tetramethyl-piperidin-4-yl)imino)-1,6-hexanediyl((2,2,6,6-tetramethyl-4-piperidinyl)imino)] (CAS Registry Number 71878-19-8), (viii) a copolymer of N,N-bis-(2,2,6,6-tetramethyl-piperidin-4-yl)-hexane-1,6-diamine, 2,4,6-trichloro-[1,3,5]triazine, and 2,4,4-trimethyl-1,2-pentanamine (CAS Registry Number 70624-18-9), (ix) a copolymer of N,N-bis-(2,2,6,6-tetramethyl-piperidin-4-yl)-hexane-1,6-diamine and morpholine-2,4,6-trichloro-[1,3,5]triazine (CAS Registry Number 193098-40-

7), and (x) combinations thereof. Preferably, the polymer is selected from the group consisting of (i) poly[(6-morpholino-s-triazine-2,4-diyl)[(2,2,6,6-tetramethyl-piperidin-4-yl) imino]-hexamethylene[(2,2,6,6-tetramethyl-piperidin-4-yl) imino)]] (CAS Registry Number 082451-48-7), (ii) a copolymer of 2,2,6,6,-tetramethyl-piperidin-4-amine, maleic anhydride, and $C_{20}$-$C_{24}$ alkenes (CAS Registry Number 152261-33-1), (iii) poly[(6-((1,1,3,3-tetramethylbutyl)amino)-1,3,5-triazine-2,4-diyl)((2,2,6,6-tetramethyl -piperidin-4-yl) imino)-1,6-hexanediyl((2,2,6,6-tetramethyl-4-piperidinyl) imino)] (CAS Registry Number 71878-19-8), (iv) a copolymer of N,N-bis-(2,2,6,6-tetramethyl-piperidin-4-yl)-hexane-1,6-diamine, 2,4,6-trichloro-[1,3,5]triazine, and N-butyl-1-butanamine (CAS Registry Number 192268-64-7), and (v) combinations thereof. Most preferably, the polymer is poly[(6-morpholino-s-triazine-2,4-diyl)[(2,2,6,6-tetramethyl-piperidin -4-yl)imino]-hexamethylene[(2,2,6,6-tetramethyl-piperidin-4-yl) imino)]] (CAS Registry Number 082451-48-7).

The polymer utilized in the second embodiment of the treated textile can comprise secondary, hindered amine moieties conforming to structure (VIII)

(VIII)

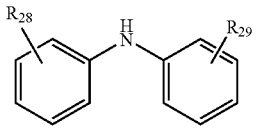

In structure (VIII), $R_{28}$ is selected from the group consisting of hydrogen atoms, alkyl groups, aryl groups, amine groups, amide groups, and combinations thereof. $R_{29}$ is a group linking the hindered amine moiety to the polymer chain.

The polymer utilized in the second embodiment of the treated textile material can comprise secondary hindered amine moieties conforming to structure (IX)

(IX)

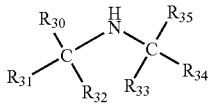

In structure (IX), $R_{30}$, $R_{32}$, $R_{33}$, and $R_{35}$ are independently selected from the group consisting of $C_1$-$C_4$ alkyl groups. $R_{31}$ and $R_{34}$ are independently selected from the group consisting of an alkyl group, an aryl group, an amine group, an amide group, and combinations thereof, provided that at least one of $R_{31}$ and $R_{34}$ is a group linking the hindered amine moiety to the polymer chain.

The polymer utilized in the second embodiment of the treated textile material can comprise secondary hindered amine moieties conforming to structure (X)

(X)

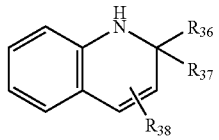

In structure (X), $R_{36}$ and $R_{37}$ are independently selected from the group consisting of $C_1$-$C_4$ alkyl groups, and $R_{38}$ is a group linking the hindered amine moiety to the polymer chain. Suitable polymers comprising hindered amine moieties conforming to structure (X) include, but are not limited to, a homopolymer or copolymer of 2,2,4-trimethyl-1,2-dihydroquinoline.

The polymer utilized in the second embodiment of the treated textile material can comprise secondary hindered amine moieties conforming to structure (XI)

(XI)

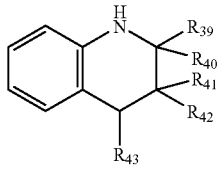

In structure (XI), $R_{39}$, $R_{40}$, $R_{41}$, and $R_{42}$ are independently selected from the group consisting of $C_1$-$C_4$ alkyl groups, and $R_{43}$ is a group linking the hindered amine moiety to the polymer chain.

The finish or coating comprising a reaction product of the cross linking agent and the polymer can be present on the textile material in any suitable amount. Typically, the finish is present on the treated textile material in an amount such that the textile material exhibits antimicrobial properties or can be made to exhibit antimicrobial properties, for example, by contacting the textile material with an aqueous hypohalite solution. For example, the finish can be present on the textile material in an amount such that the reaction product of the cross linking agent and the polymer are present in an amount that the textile material is rendered antimicrobial after it has been exposed to an aqueous solution of a hypohalite (e.g., an aqueous hypochlorite-containing solution). Upon exposure to an aqueous solution of a hypohalite (e.g., an aqueous hypochlorite-containing solution), these hindered amine moieties will undergo an equilibrium reaction similar to that described above for the hindered amine compounds. In particular, the hindered amine moieties present on the reaction product will undergo an equilibrium reaction in which a protonated hypohalite ion reacts with the nitrogen atom of the hindered amine moiety to replace the hydrogen atom with a halogen atom and eliminate water. Typically, the finish is present on the treated textile material in an amount of about 1 wt. % or more, based on the total weight of the treated textile material. In such embodiments, the finish typically is present in an amount of about 10 wt. % or less, or about 5 wt. % or less, based on the total weight of the treated textile material.

The invention also provides a second method for treating a textile material comprising the steps of (a) providing a textile material having at least one surface to be treated, (b) contacting at least a portion of the surface of the textile material with a polymer comprising a plurality of secondary, hindered amine moieties attached to the polymer chain to deposit the polymer on the contacted portion of the surface, and (c) reacting the polymer deposited on the surface of the textile material in step (b) with a cross-linking agent to cross-link the polymer.

The textile materials suitable for treatment using this second method embodiment can be any suitable textile material, including those textile materials described above as being suitable for the first and second embodiments of the treated textile material.

As noted above, the polymer utilized in the second method embodiment comprises a plurality of (e.g., at least two, preferably at least three) secondary, hindered amine moieties attached to the polymer chain or backbone. The polymer can be any suitable polymer falling into this category including, but not limited to, those polymers described above as being suitable for the second embodiment of the treated textile material.

The textile material to be treated can be contacted with the polymer by any suitable method. For example, the polymer can be dissolved or suspended within a suitable solvent or carrier, and the textile material can be immersed in the solution or suspension so that the material takes up a portion of the solvent or carrier along with the polymer. In such an embodiment, the textile material to be treated can be contacted with the solvent or carrier containing the polymer using any suitable apparatus. For example, the textile material can be immersed in the solvent or carrier using a typical piece dyeing apparatus, such as a jet-dyeing machine. Alternatively, the solvent or carrier containing the polymer can be sprayed onto the surface of the textile material to be treated. In another embodiment, the polymer can be applied to the surface of the textile material using a foam application method, in which the polymer is carried by a foam composition that is applied to a surface of the textile material to be treated. The treated textile material can also be contacted a with the polymer using conventional spray, dip coating, or impregnation processes, as described above for the first method embodiment of the invention. In each of the aforementioned means for contacting the textile material with the polymer, the solvent or carrier used for the polymer can be any suitable solvent or carrier, including those compositions described above for the first method embodiment of the invention. Preferably, the composition used to apply the polymer to the textile material is an acidic aqueous solution comprising a volatile acid, as described above for the first method embodiment of the invention.

After the textile material is contacted with the polymer, the polymer is reacted with a suitable cross-linking agent. The cross-linking agent utilized in the second method embodiment can be any suitable cross-linking agent including, but not limited to, those cross-linking agents described above as being suitable for the second embodiment of the treated textile material. The polymer can be reacted with the cross-linking agent using any suitable method. For example, the cross-linking agent can be dissolved or suspended within a suitable solvent or carrier, and the textile material can be immersed in the solution or suspension so that the material takes up a portion of the solvent or carrier along with the cross-linking agent, which then reacts with the polymer. In such an embodiment, the textile material to be treated can be contacted with the solvent or carrier containing the cross-linking agent using any suitable apparatus. For example, the textile material can be immersed in the solvent or carrier using a typical piece dyeing apparatus, such as a jet-dyeing machine. Alternatively, the solvent or carrier containing the cross-linking agent can be sprayed onto the surface of the textile material to be treated. In another embodiment, the cross-linking agent can be applied to the surface of the textile material using a foam application method, in which the cross-linking agent is carried by a foam composition that is applied to a surface of the textile material to be treated.

Any suitable amount of the cross-linking agent can be used in the method described above. Typically, the amount of cross-linking agent is selected so that the polymer retains unreacted hindered amine moieties. The molar ratio of cross-linking agent to hindered amine moieties, for example, typically is greater than about 0.1:1. For example, when a methyl ethyl ketoxime blocked polymeric hexamethylenediisocyanate cross-linking agent is used, the molar ratio of the cross-linking agent to hindered amine moieties is about 0.2:1 to about 2:1. While this ratio includes a molar excess of the cross-linking agent, processes utilizing such ratios of cross-linking agent to hindered amine moieties have been observed to yield a treated textile material having unreacted hindered amine moieties. While not wishing to be bound to any particular theory, it is believed that the presence of such unreacted hindered amine moieties is due to incomplete reaction of the cross-linking agent with the hindered amine moieties and/or competitive reactions of the cross-linking agent with other portions of the polymer or other components present in the composition.

While the foregoing discussion of the second method embodiment has described the method as involving sequential steps of applying the polymer and then reacting the polymer with a suitable-cross linking agent, the second method embodiment also encompasses methods in which the polymer and the cross-linking agent are simultaneously or nearly simultaneously applied to the textile material. For example, the polymer and the cross-linking agent can be delivered as separate compositions to a suitable foaming apparatus, where the two compositions can be foamed onto the surface of the textile material to be treated. Alternatively, the polymer and the cross-linking agent can be sprayed onto the surface of the textile material to be treated as two separate compositions using two spray apparatus, or the polymer and cross-linking agent can be combined into a single composition (preferably just before being applied to the textile material) that is then sprayed onto the surface of the textile material to be treated. The polymer and the cross-linking agent can also be coated, padded or printed onto the surface of the textile material to be treated as two separate compositions using apparatus, or the polymer and cross-linking agent can be combined into a single composition (preferably just before being applied to the textile material) that is then coated, padded or printed onto the surface of the textile material to be treated.

After the polymer and the cross-linking agent have been applied to the textile material, the textile material can be dried by passing the textile material through an oven at an elevated temperature to evaporate any carrier or solvent used to apply the polymer and/or cross-linking agent to the textile material. While not wishing to be bound to any particular theory, it is believed that the elevated temperatures will also activate and accelerate the reaction between the cross-linking agent and the hindered amine moieties present in the polymer. Suitable temperatures for activating this cross-linking reaction may depend upon, among other things, the particular cross-linking agent and polymer used. Typically, the activation temperature is in the range of about 120 to about 200° C., preferably about 150 to about 180° C. For example, when the cross-linking agent contains methylol groups, a suitable activation temperature typically is about 125 to about 190° C. When the cross-linking agent is a methyl ethyl ketoxime blocked isocyanate cross-linking agent, a suitable activation temperature typically is about 135 to about 190° C.

As with certain of the first embodiments of the treated textile material of the invention, the second embodiment of the treated textile material and the treated textile material produced by the second method embodiment can be rendered antimicrobial by exposing the treated textile material to an aqueous solution of a hypohalite (e.g., an aqueous hypochlorite-containing solution containing about 0.001 to about 1% by weight of a hypochlorite, such as sodium hypochlorite) or other dilute oxidative halogenated solutions. As noted above, the term "oxidative halogen solution" refers to a solution containing a halogen-containing species in which the halogen is in an oxidative valent state (i.e., a zero or positive valence state). Suitable oxidative halogen solutions include, but are not limited to, solutions of sodium hypochlorite, potassium hypobromite, chlorine oxide, sodium periodate, iodine, bromine, and combinations thereof. While not wishing to be bound to any particular theory, it is believed that at least a portion of the secondary hindered amine moieties remaining on the polymer undergo a reaction with the halogen-containing species in the oxidative halogen solution in which the species reacts with the nitrogen atom of the hindered amine moiety to replace the hydrogen with a halogen atom and eliminate water, thereby producing a halamine. The oxidative halogen solution can be applied to the treated textile material by any suitable method. For example, the oxidative halogen solution can be added to the rinse liquid used in a typical laundering process, or the oxidative halogen solution can be sprayed and/or wiped onto the surface of the textile material.

In certain particular embodiments, the treated textile material of the invention can be rendered antimicrobial by exposing the treated textile material to an iodine-containing solution. While not wishing to be bound to any particular theory, it is believed that the iodine reacts with the secondary hindered amine moieties present on the polymer in the finish to produce an "iodo-amine" or an iodine-amine complex. This iodo-amine or an iodine-amine complex has been observed to exhibit a light yellow color, which can act as a visual indication of the formation of the antimicrobial iodo-amine or iodine-amine complex on a textile material that has been so treated. Furthermore, the iodo-amine or iodine-amine complex has been observed to exhibit relatively good wash durability.

In order to lessen the potential irritation to persons utilizing the treated textile materials of the invention, the textile material preferably is rinsed after it is exposed to the oxidative halogen solution. The treated textile material can be rinsed in water alone; however, the treated textile material preferably is rinsed with a solution containing a reducing agent, such as those described in U.S. Pat. Nos. 6,482,756 (Li) and U.S. Pat. No. 6,576,154 (Li), which are hereby incorporated by reference. While not wishing to be bound to any particular theory, it is believed that rinsing with a suitable reducing agent will significantly reduce the amount of the oxidative halogen retained by the fabric itself (e.g., the oxidative halogen retained by the fibers themselves) without significantly reducing the amount of halamines formed by the reaction of the hindered amine moieties contained in the finish with the oxidative halogen solution. Indeed, the halamines formed in the finish of the treated textile have been found to be relatively stable to rinsing with a reducing agent.

In another aspect of the second embodiment of the treated textile material and the second method embodiment of the invention, a suitable amine or amide-containing compound can be added to the finish. For example, the finish produced by reacting a combination of melamine formaldehyde resins (which is an amine and is also listed above as a cross-linking agent), a second cross-linking agent (e.g., a block isocyanate cross-linking agent), and a polymer containing a plurality of secondary hindered amine moieties has been observed to produce a treated textile material exhibiting a synergistic combination after the textile material has been exposed to an aqueous hypochlorite solution. While not wishing to be bound to any particular theory, it is believed that the amine or amide-containing compound (e.g., the melamine formaldehyde resin) also forms a halamine upon exposure to the oxidative halogen solution. Such an embodiment of the treated textile material would be expected to form higher levels of halamines and have a finish that is more durable to laundering than a treated textile material that had been produced with the second cross-linking agent and polymer alone.

The treated textile material of the invention (particularly the second embodiment of the treated textile material and the treated textile materials produced by the second method embodiment) have been observed to be surprisingly durable to industrial laundering processes. Industrial laundering processes typically are used by commercial laundry services to clean uniforms, hospital linens, towels, and linens used in hotels. Such industrial laundering processes differ from home laundering conditions in that they use more alkaline detergent solutions, higher washing temperatures, and harsher mechanical agitation. While not wishing to be bound to any particular theory, it is hypothesized that the durability of the treated textile material (i.e., the durability of the finish or coating on the treated textile material) is due, at least in part, to an affinity of the hindered amine polymer for the textile fiber and/or the intractable nature of the product formed by the reaction of the cross-linking agent and the polymer.

The following examples further illustrate the invention but, of course, should not be construed as in any way limiting its scope.

EXAMPLE 1

This example demonstrates the preparation of treated textile materials according to the invention. Three fabric samples (Samples 1A-1C) were treated by dipping the fabric samples into a bath, passing the wetted fabric through a pair of nip rollers at a pressure of approximately 280 kPa (40 psi), and drying the fabrics in an oven at a temperature of approximately 180° C. (360° F.) for approximately 5 minutes. Sample 1A was a 100% cotton fabric, sample 1B was a cotton/polyester blend fabric comprising approximately 35% cotton and approximately 65% polyester, and sample 1C was a 100% polyester fabric.

The bath into which the fabric samples were dipped was prepared by mixing approximately 1 g of acetic acid and approximately 2 g of poly[(6-morpholino-s-triazine-2,4-diyl)[(2,2,6,6-tetramethyl-piperidin -4-yl)imino]-hexamethylene[(2,2,6,6-tetramethyl-piperidin-4-yl)imino)]] (CYASORB®) UV-3346 light stabilizer available from Cytec Industries Inc.) in 10 ml of deionized water. The poly[(6-morpholino-s-triazine-2,4-diyl)[(2,2,6,6-tetramethyl-piperidin -4-yl)imino]-hexamethylene[(2,2,6,6-tetramethyl-piperidin-4-yl) imino)]] was estimated to have approximately 5.8 hindered amine moieties per molecule and approximately 3.61 millimoles of hindered amine moieties per gram of polymer solid. After the poly[(6-morpholino-s-triazine-2,4-diyl)[(2,2,6,6-tetramethyl-piperidin -4-yl)imino]-hexamethylene[(2,2,6,6-tetramethyl-piperidin-4-yl) imino)]] had completely dissolved, approximately 0.5 g of a dispersion of a methyl ethylketoxime blocked aliphatic isocyanate cross-linking agent (ARKOPHOB DAN available from Clariant Inc.) was added, and the resulting solution was diluted with deionized water to a final volume of 100 ml.

The wash durability of the finish applied to the fabric samples was then qualitatively evaluated by repeatedly washing the samples in both household and industrial laundry units and qualitatively testing the fabrics to determine the presence of retained chlorine or chloramines. In each wash procedure, approximately 0.1% of a sodium hypochlorite solution (CLOROX® bleach available from The Clorox Company) was added during the rinse cycle. The chlorine retention of the treated fabric samples (and each sample's ability to form chloramines) was then qualitatively determined by marking each fabric sample with a colorless aqueous indicator. The solution leaves a colorless mark on a fabric that does contain any retained chlorine or chloramines. However, the indicator solution leaves a yellow to brown mark on fabric containing retained chlorine or chloramines.

Samples 1A and 1B both exhibited a brown color upon application of the indicator after separate samples had each been subjected to 20 home and 20 industrial laundry cycles, indicating the presence of retained chlorine or chloramines on the fabric. The colors exhibited by Samples 1A and 1B upon application of the indicator were more intense than the light brown colors exhibited by similar fabric samples that had been subjected to the same laundering regimens but had not been treated in accordance with the invention. Sample 1C exhibited a strong yellow color upon application of the indicator after the sample had subjected to 50 industrial laundry cycles. However, a similar untreated polyester fabric sample that had been subjected to the same laundering regiment did not show any color upon application of the indicator. These results demonstrate that fabrics treated in accordance with the invention exhibit increased chlorine retention relative to similar fabrics that have not been treated in accordance with the invention.

EXAMPLE 2

This example demonstrates the preparation of treated textile materials according to the invention and the antimicrobial properties exhibited by the same. Four fabric samples (Samples 2A-2D) were treated by dipping the fabric samples into a bath, passing the wetted fabric through a pair of nip rollers at a pressure of approximately 280 kPa (40 psi), and drying the fabrics at a temperature of approximately 180° C. (360° F.) for approximately 5 minutes. Sample 2A was a 100% cotton fabric, sample 2B was a cotton/polyester blend fabric comprising approximately 35% cotton and approximately 65% polyester, sample 2C was a 100% polyester fabric, and sample 2D was a polyester non-woven fabric.

The bath into which the fabric samples were dipped was prepared by mixing approximately 1 g of acetic acid and approximately 2 g of poly[(6-morpholino-s-triazine-2,4-diyl)[(2,2,6,6-tetramethyl-piperidin -4-yl)imino]-hexamethylene[(2,2,6,6-tetramethyl-piperidin-4-yl) imino)]] (CYASORB®) UV-3346 light stabilizer available from Cytec Industries Inc.) in 10 ml of deionized water. After the poly [(6-morpholino-s-triazine-2,4-diyl)[(2,2,6,6-tetramethyl-piperidin -4-yl)imino]-hexamethylene[(2,2,6,6-tetramethyl-piperidin-4-yl) imino)]] had completely dissolved, approximately 0.5 g of a dispersion of a methyl ethylketoxime blocked aliphatic isocyanate cross-linking agent (ARKOPHOB DAN available from Clariant Inc.) and approximately 2 g of a melamine formaldehyde resin (CYMEL® 385 resin available from Cytec Industries Inc.) were added, and the resulting solution was diluted with deionized water to a final volume of 100 ml.

The wash durability of the finish applied to the fabric samples was then qualitatively evaluated in the same manner as described in Example 1. After 30 laundering cycles, each of the fabric samples exhibited significant color change upon application of the indicator, indicating the presence of retained chlorine or chloramines on the fabric.

Following 30 industrial laundering cycles, Sample 2D was tested to determine the antimicrobial properties exhibited by the fabric. The fabric was tested against *Staphylococccus aureus* bacterium in accordance with Japanese Industrial Standard JIS L 1902:1988, entitled "Testing method for antibacterial of textiles," to determine its logarithmic reduction of the bacteria relative to an untreated fabric. In two separate trials, Sample 2D exhibited a logarithmic reduction of approximately 3.22, which is equivalent to the maximum logarithmic reduction value that could be measured for these particular tests.

EXAMPLE 3

This example demonstrates the production of treated textile materials according to the invention. Two 100% polyester woven fabric samples (Samples 3A and 3B) were treated in a dyejet, which contained a hindered amine compound and approximately 2% by weight of acetic acid, for approximately 30 minutes at a temperature of approximately 130° C. The treated fabric samples were rinsed and dried at a temperature of approximately 180° C. (350° F.) for approximately 5 minutes. The solution used to treat Sample 3A comprised approximately 1% (on weight of the fabric) of 3-dodecyl-1-(2,2,6,6-tetramethyl-piperidin-4-yl)-pyrrolidine -2,5-dione (CYASORB®) UV-3581 light stabilizer available from Cytec Industries Inc.), and the solution used to treat Sample 3B contained approximately 3% (on weight of the fabric) of poly[(6-morpholino-s-triazine-2,4-diyl)[(2,2,6,6-tetramethyl -piperidin-4-yl) imino]-hexamethylene[(2,2,6,6-tetramethyl-piperidin-4-yl)imino)]] (CYASORB® UV-3346 light stabilizer available from Cytec Industries Inc.).

The wash durability of the finish applied to the fabric samples was then qualitatively evaluated in the same manner as described in Example 1. After five washing and drying cycles, each of the fabric samples exhibited significant color change upon application of the indicator, indicating the presence of retained chlorine or chloramines on the fabric. However, a similar fabric sample that had not been treated in accordance with the invention did not exhibit an observable change in color upon application of the indicator.

EXAMPLE 4

This example demonstrates the production of treated textile materials according to the invention and the antimicrobial properties and active chlorine content of the same. Two fabric samples (Samples 4A and 4B) were produced in accordance with the procedure set forth in Example 1. Sample 4A was a cotton/polyester blend fabric comprising approximately 35% cotton and approximately 65% polyester, and Sample 4B was a 100% polyester fabric.

Two additional fabric samples (Samples 4C and 4D) were treated with 1,3-dimethylol-5,5-dimethylhydantoin (DMDMH) in accordance with Example II of U.S. Pat. No. 5,882,357 (Sun et al.). Sample 4C was a cotton/polyester blend fabric comprising approximately 35% cotton and approximately 65% polyester, and Sample 4D was a 100% polyester fabric. Two additional untreated fabric samples (Samples 4E and 4F) were utilized as additional comparative examples. Sample 4E was a cotton/polyester blend fabric comprising approximately 35% cotton and approximately 65% polyester, and Sample 4F was a 100% polyester fabric.

Each of Samples 4A-4F were washed once in a conventional, household washing machine, and then rinsed in the same household washing machine with a rinse liquid containing approximately 0.1% of a sodium hypochlorite solution (CLOROX®) bleach available from The Clorox Company). The samples were then dried in a conventional, household clothes dryer for approximately 30 minutes.

The samples were then tested to determine active chlorine content of the laundered samples. The active chlorine content was determine by first cutting a small piece of fabric from each of Samples 4A-4F and weighing each fabric piece to determine its mass in grams ($W_{fabric}$). Each of the fabric pieces was then cut into small strips measuring approximately 5 mm by 2 mm so that the fabric pieces could be easily placed into a solution for titration. The strips for each fabric piece were then placed in separate flasks, and 25 ml of a 0.05 N solution of sulfuric acid and 50 ml of deionized water were added to each flask. Next, approximately 1.5 g of potassium iodide was added to each flask, and the flasks were sealed and stirred at room temperature for approximately 30 minutes. The solution contained in each flask was then titrated with a standard sodium thiosulfate solution having a concentration ($C_{standard}$) of approximately 0.001 M until the solution turned a light yellow color. Approximately 1 ml of a 1% starch solution was then added to each flask, at which point the solution turned a blue color. The solution contained in each flask was then titrated further with the standard sodium thiosulfate solution until it was colorless. The final volume of the standard sodium thiosulfate solution added ($V_{standard}$) was then recorded. Using the values obtained from the above-described titration, the active chlorine content ($C_{Cl}$) of each sample in parts-per-million (grams of active chlorine per million grams of the fabric sample) was then determined using the following equation:

$$C_{Cl} = \frac{1.775 \times 10^7 \times C_{standard} \times V_{standard}}{W_{fabric}}$$

The active chlorine content for each of Samples 4A-4F determined using the above-described titration method and calculation are set forth in Table 1 below.

TABLE 1

Measured active chlorine content for Samples 4A-4F.

| | Sample | | | | | |
|---|---|---|---|---|---|---|
| | 4A | 4B | 4C | 4D | 4E | 4F |
| $C_{Cl}$ (ppm) | 202 | 38 | 394 | 19 | 327 | 15 |

As evidenced by the data set forth in Table 1, the polyester fabric treated in accordance with the invention (Sample 4B) exhibited a higher active chlorine content that the sample treated with DMDMH (Sample 4D) and the untreated sample (Sample 4F). However, the polyester-cotton blend fabric treated in accordance with the invention (Sample 4A) exhibited a lower active chlorine content than both the sample treated with DMDMH (Sample 4C) and the untreated sample (Sample 4E). Thus, it is believed that the titration procedure underestimates the active chlorine content of the fabrics treated in accordance with the invention due to the fact that some of the chlorine and/or iodine (as the reaction product of chlorine on the fabric and the added potassium iodide in solution) is retained by the finish on the fabric and not released into the solution for titration. Indeed, further evidence of this retention of the chlorine and/or iodine is indicated by the persistent yellow color of the fabric after the potassium iodide was added.

Fabric samples 4B, 4D, and 4F were tested to determine their activity against a pathogenic bacteria, namely methicillin-resistant *Staphylococcus aureus* (ATCC® Number 43300) (hereinafter, "MRSA"). The antimicrobial activity of the fabric samples was determined in accordance with JIS L 1902:1998 using the procedure described below. The fabric samples were tested by first cutting a fabric swatch from each of the samples measuring approximately 2 inches by 2 inches, and then placing each swatch into a 50 ml plastic centrifuge tube so that the fabric was suspended above the bottom of the centrifuge tube. Each of the fabric swatches was then inoculated with approximately 0.5 ml of a suspension of approximately $1\times10^5$ cells/ml of MRSA in approximately 5% nutrient broth in saline. The cell suspension was applied to the fabric swatches so that the inoculum was completely absorbed by the fabric swatch (i.e., the inoculum did not drip through or runoff of the swatches). The inoculated fabric swatches were then incubated at a temperature of approximately 37° C. for approximately 60 minutes. Following incubation, the fabrics were washed with approximately 10 ml of a wash solution, which contained approximately 3% Tryptic Soy Broth, approximately 0.7% of a polyoxyethylene sorbitan monooleate surfactant (Tween™ 80 available from Uniqema), and approximately 0.01% L-cysteine. The number of viable cells contained in the wash solution for each sample was then determined using standard microbiological techniques. After the number of MRSA cells had been counted, the logarithmic reduction versus the initial bioburden was then calculated. The results of the calculations are set forth in Table 2 below.

TABLE 2

Logarithmic reduction of MRSA for Samples 4B, 4D, and 4F.

| | Sample | | |
|---|---|---|---|
| | 4B | 4D | 4F |
| Log Reduction | 2.24 | 0.22 | 0.81 |

As evidenced by the data set forth in Table 2, the fabric treated in accordance with the invention (Sample 4B) exhibited a greater logarithmic reduction of MRSA than both the fabric treated with DMDMH (Sample 4D) and the untreated fabric (Sample 4F).

EXAMPLE 5

This example demonstrates the active chlorine content of textile materials produced in accordance with the invention. Two samples (Samples 5A and 5B) were prepared in accordance with the procedure set forth in Example 2. Two additional, untreated fabric samples (Samples 5C and 5D) were used for purposes of comparison. Samples 5A and 5C were similar cotton/polyester blend fabrics comprising approximately 35% cotton and approximately 65% polyester, and Samples 5B and 5D were similar 100% polyester fabrics.

Each of the fabric samples was washed once in a conventional, household washing machine and rinsed with a rinse liquid containing approximately 0.1% of a sodium hypochlorite solution (CLOROX®) bleach available from The Clorox Company). The active chlorine content was then measured in accordance with the procedure set forth in Example 4. The results of these measurements are set forth in Table 3 below.

TABLE 3

Measured active chlorine content of Samples 5A-5D.

| | Sample | | | |
|---|---|---|---|---|
| | 5A | 5B | 5C | 5D |
| $C_{Cl}$ (ppm) | 185 | 82 | 327 | 15 |

As evidenced by the data set forth in Table 3, the polyester fabric treated in accordance with the invention (Sample 5B) exhibited a higher active chlorine content than the untreated sample (Sample 5D). However, the polyester-cotton blend fabric treated in accordance with the invention (Sample 5A) exhibited a lower active chlorine content than the untreated sample (Sample 5C). Thus, as noted above, it is believed that the titration procedure underestimates the active chlorine content of the fabrics treated in accordance with the invention due to the fact that the chlorine is retained by the finish on the fabric and not released into the solution in the titration procedure. Furthermore, the measured active chlorine content for Sample 5C appears to suggest that the cotton fiber of the polyester/cotton blend fabric retains significant amounts of chlorine.

EXAMPLE 6

This example demonstrates the active chlorine content of textile materials produced in accordance with the invention. Eight fabric samples (Samples 6A-6H) were tested to determine their active chlorine content after the samples had undergone 50 laundering cycles, as described in Example 1. Samples 6A and 6B were prepared in the same manner as Samples 4A and 4B, respectively, of Example 4. Samples 6C and 6D were prepared in the same manner as Samples 5A and 5B, respectively, of Example 5. Samples 6E and 6F were prepared in the same manner as Samples 4C and 4D, respectively, of Example 4. Sample 6G was an untreated cotton/polyester blend fabric comprising approximately 35% cotton and approximately 65% polyester, and Sample 6H was an untreated 100% polyester fabric. The results of the active chlorine content measurements are set forth in Table 4 below.

TABLE 4

Measured active chlorine content of Samples 6A-6H.

| | Sample | | | | | | | |
|---|---|---|---|---|---|---|---|---|
| | 6A | 6B | 6C | 6D | 6E | 6F | 6G | 6H |
| $C_{Cl}$ (ppm) | 34 | 18 | 58 | 32 | 28 | 9 | 20 | 4 |

As evidenced by the data set forth in Table 4, the textile materials treated in accordance with the invention (Samples 6A-6D) all exhibited an active chlorine content higher than their corresponding comparative samples. For example, the cotton/polyester blend fabrics treated in accordance with the invention (Samples 6A and 6C) both exhibited active chlorine contents well in excess of the active chlorine content of the samples treated with DMDMH (Sample 6E) and the untreated sample (Sample 6G). Sample 6G, which was the untreated polyester/cotton blend fabric, exhibited very little chlorine retention after 50 industrial laundering cycles, which is believed to be due to significant loss of cotton fibers from the fabric caused by the hard conditions of the laundering process. The polyester fabric samples treated in accordance with the invention (Samples 6B and 6D) also exhibited active chlorine contents well in excess of the active chlorine content of the sample treated with DMDMH (Sample 6F) and the untreated sample (Sample 6H).

EXAMPLE 7

This example demonstrates the active chlorine content of textile materials produced in accordance with the invention. Eight fabric samples (Samples 7A-7H) were tested to determine their active chlorine content after the samples had undergone 50 laundering cycles, as described in Example 1, and an additional laundering cycle with an antichlor rinse of approximately 0.1% by weight $(NH_4)_2S_2O_3$. Samples 7A and 7B were prepared in the same manner as Samples 4A and 4B, respectively, of Example 4. Samples 7C and 7D were prepared in the same manner as Samples 5A and 5B, respectively, of Example 5. Samples 7E and 7F were prepared in the same manner as Samples 4C and 4D, respectively, of Example 4. Sample 7G was an untreated cotton/polyester blend fabric comprising approximately 35% cotton and approximately 65% polyester, and Sample 7H was an untreated 100% polyester fabric. The results of the active chlorine content measurements are set forth in Table 5 below.

TABLE 5

Measured active chlorine content of Samples 6A-6H.

| | Sample | | | | | | | |
|---|---|---|---|---|---|---|---|---|
| | 7A | 7B | 7C | 7D | 7E | 7F | 7G | 7H |
| $C_{Cl}$ (ppm) | 36 | 14 | 50 | 16 | 6 | <1 | 22 | <1 |

As evidenced by the data set forth in Table 5, the textile materials treated in accordance with the invention (Samples 7A-7D) all exhibited an active chlorine content higher than their corresponding comparative samples. For example, the cotton/polyester blend fabrics treated in accordance with the invention (Samples 7A and 7C) both exhibited active chlorine contents well in excess of the active chlorine content of the samples treated with DMDMH (Sample 7E) and the untreated sample (Sample 7G). Also, the polyester fabric samples treated in accordance with the invention (Samples 7B and 7D) both exhibited active chlorine contents well in excess of the active chlorine content of the sample treated with DMDMH (Sample 7F) and the untreated sample (Sample 7H).

Following 51 industrial laundering cycles, Samples 7C and 7D were tested to determine the antimicrobial properties exhibited by the fabric. The samples were tested against *Staphylococcus aureus* bacterium in accordance with JIS L 1902:1998. Using this test method, Sample 7C exhibited a logarithmic reduction of the bacteria of approximately 2.94, and Sample 7D exhibited a logarithmic reduction of the bacteria of approximately 2.06.

EXAMPLE 8

This example demonstrates the preparation of a treated textile material according to the invention. A 100% polyester fabric (Sample 8A) was prepared in accordance with the procedure set forth in Example 1. The treated fabric sample was then immersed in an iodine solution for approximately 5 minutes. The iodine solution contained approximately 1 g of iodine and approximately 4 g of potassium iodide in approximately 95 g of deionized water. After immersion in the iodine solution, the fabric sample exhibited a yellow color, which is believed to have indicated the presence of retained iodine on the fabric.

Sample 8A was then subjected to a typical household laundering cycle. Following the laundering cycle, Sample 8A retained the yellow color while a similar untreated sample lost its yellow color following a similar laundering cycle. As noted above, it is believed that the yellow color exhibited by the fabric sample indicated the presence of retained iodine on the fabric.

Sample 8A was then tested to determine the antimicrobial properties exhibited by the fabric. The sample was tested against the *Staphylococcus aureus* bacterium as in Example 2. In two separate trials, Sample 8A exhibited maximum logarithmic reduction of the bacteria.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A treated textile material comprising a plurality of yarns or fibers having an exterior surface and an interior portion, the yarns or fibers comprising about 1 wt. % or more, based on the weight of the yarns or fibers, of a hindered halamine compound disposed on the exterior surface of the yarns or fibers and/or dispersed in the interior portion of the yarns or fibers, wherein the hindered halamine compound has a molecular weight of about 2000 atomic mass units or less and is a halogenated analogue of poly[(6-morpholino-s-triazine-2,4-diyl)[(2,2,6,6-tetramethyl-piperidin -4-yl) imino]-hexamethylene [(2,2,6,6-tetramethyl-piperidin-4-yl) imino)]] in which a hydrogen atom of at least one of a 2,2,6,6-tetramethyl-piperidin-4-yl moiety has been replaced with a halogen selected from the group consisting of chlorine, bromine, and iodine.

2. The treated textile material of claim 1, wherein the yarns or fibers comprise a fiber selected from the group consisting of cellulose, polyamides, polyesters, polyethylenes, polypropylenes, polyacrylics, and combinations thereof.

3. A treated textile material comprising a finish on a surface thereof, the finish comprising a product of a reaction between a cross-linking agent and a polymer, the polymer comprising a polymer chain and a plurality of secondary, hindered amine moieties attached to the polymer chain, wherein at least a portion of the hindered amine moieties attached to the polymer chain have been halogenated to replace an amine hydrogen with a halogen selected from the group consisting of a chlorine atom, a bromine atom, or an iodine atom, wherein the plurality of secondary, hindered amine moieties comprises moieties conforming to structure (VII)

(VII)

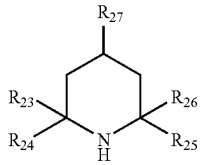

wherein $R_{23}$, $R_{24}$, $R_{25}$, and $R_{26}$ are independently selected from the group consisting of $C_1$-$C_4$ alkyl groups and $R_{27}$ is a group linking the hindered amine moiety to the polymer chain, and wherein the polymer is selected from the group consisting of (i) a copolymer of N,N-bis-(2,2,6,6-tetramethyl-piperidin-4-yl)-propane-1,3-diamine, N,N-bis-(2,2,6,6-tetramethyl-piperidin-4-yl)-hexane-1,6-diamine, and N-butyl-2,2,6,6-tetramethylpiperidin-4-amine, (ii) a copolymer of N-butyl-2,2,6,6-tetramethylpiperidin-4-amine, $N^1$-(2,2,6,6-tetramethyl-piperidin-4-yl)-hexane-1,6-diamine, and 2,4,6-trichloro-[1,3,5]triazine, (iii) a copolymer or homopolymer of 2,2,6,6-tetramethyl-piperidin-4-yl methacrylate, (iv) a copolymer of 2,2,6,6,-tetramethyl-piperidin-4-amine, maleic anhydride, and $C_{20}$-$C_{24}$ alkenes, (v) poly[(6-morpholino-s-triazine-2,4-diyl)[(2,2,6,6-tetramethyl-piperidin -4-yl) imino]-hexamethylene [(2,2,6,6-tetramethyl-piperidin-4-yl) imino)]], (vi) a copolymer of N,N-bis-(2,2,6,6-tetramethyl-piperidin-4-yl)-hexane-1,6-diamine, 2,4,6-trichloro-[1,3,5]triazine, and N-butyl-1-butanamine, (vii) poly[(6-((1,1,3,3-tetramethylbutyl)amino)-1,3,5-triazine-2,4-diyl)((2,2,6,6-tetramethyl -piperidin-4-yl) imino)-1,6-hexanediyl((2,2,6,6-tetramethyl-4-piperidinyl)imino)], (viii) a copolymer of N,N-bis-(2,2,6,6-tetramethyl-piperidin-4-yl)-hexane-1,6-diamine, 2,4,6-trichloro-[1,3,5]triazine, and 2,4,4-trimethyl-1,2-pentanamine, (ix) a copolymer of N,N-bis-(2,2,6,6-tetramethyl-piperidin-4-yl)-hexane-1,6-diamine and morpholine-2,4,6-trichloro-[1,3,5]triazine, and (x) combinations thereof.

4. A treated textile material comprising a finish on a surface thereof, the finish comprising a product of a reaction between a cross-linking agent and a polymer, the polymer comprising a polymer chain and a plurality of secondary, hindered amine moieties attached to the polymer chain, wherein at least a portion of the hindered amine moieties attached to the polymer chain have been halogenated to replace an amine hydrogen with a halogen selected from the group consisting of a chlorine atom, a bromine atom, or an iodine atom, wherein the plurality of secondary, hindered amine moieties comprises moieties conforming to structure (VIII)

(VIII)

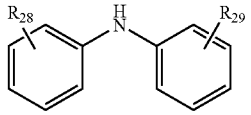

wherein $R_{28}$ is selected from the group consisting of hydrogen atoms, alkyl groups, aryl groups, amine groups, amide groups, and combinations thereof, and $R_{29}$ is a group linking the hindered amine moiety to the polymer chain.

5. A treated textile material comprising a finish on a surface thereof, the finish comprising a product of a reaction between a cross-linking agent and a polymer, the polymer comprising a polymer chain and a plurality of secondary, hindered amine moieties attached to the polymer chain, wherein at least a portion of the hindered amine moieties attached to the polymer chain have been halogenated to replace an amine hydrogen with a halogen selected from the group consisting of a chlorine atom, a bromine atom, or an iodine atom, wherein the plurality of secondary, hindered amine moieties comprises moieties conforming to structure (X)

(X)

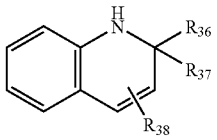

wherein $R_{36}$ and $R_{37}$ are independently selected from the group consisting of $C_1$-$C_4$ alkyl groups and $R_{38}$ is a group linking the hindered amine moiety to the polymer chain.

6. The treated textile material of claim 5, wherein the polymer is a homopolymer or copolymer of 2,2,4-trimethyl-1,2-dihydroquinoline.

7. A treated textile material comprising a finish on a surface thereof, the finish comprising a product of a reaction between a cross-linking agent and a polymer, the polymer comprising a polymer chain and a plurality of secondary, hindered amine moieties attached to the polymer chain, wherein at least a portion of the hindered amine moieties attached to the polymer chain have been halogenated to replace an amine hydrogen with a halogen selected from the group consisting of a chlorine atom, a bromine atom, or an iodine atom, wherein the plurality of secondary, hindered amine moieties comprises moieties conforming to structure (XI)

(XI)

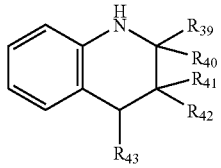

wherein $R_{39}$, $R_{40}$, $R_{41}$, and $R_{42}$ are independently selected from the group consisting of $C_1$-$C_4$ alkyl groups, and $R_{43}$ is a group linking the hindered amine moiety to the polymer chain.

8. The treated textile material of claim 3, wherein the cross-linking agent is selected from the group consisting of aliphatic isocyanates, aromatic isocyanates, epoxy resins, melamine formaldehyde resins, urea formaldehyde resins, polycarbodiimide resins, aziridines, azetidium, chloro-triazines, and combinations thereof.

9. A treated textile material comprising a plurality of yarns or fibers having an exterior surface and an interior portion, the yarns or fibers comprising about 1 wt. % or more, based on the weight of the yarns or fibers, of a polymeric hindered amine compound disposed on the exterior surface of the yarns or fibers and/or dispersed in the interior portion of the yarns or fibers, wherein the polymeric hindered amine compound comprises a polymer chain and three or more secondary, hindered amine moieties attached to the polymer chain, the secondary, hindered amine moieties being independently selected from the group of hindered amine moieties conforming to the structure (VII)

(VII)

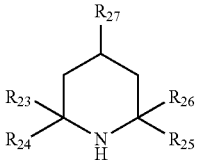

wherein $R_{23}$, $R_{24}$, $R_{25}$, and $R_{26}$ are independently selected from the group consisting of $C_1$-$C_4$ alkyl groups and $R_{27}$ is a group linking the hindered amine moiety to the polymer chain, wherein at least a portion of the secondary, hindered amine moieties on the polymeric hindered amine compound have been halogenated to replace an amine hydrogen with a halogen selected from the group consisting of chlorine, bromine, and iodine, wherein the yarns or fibers comprise a fiber selected from the group consisting of cellulose, polyamides, polyesters, polyethylenes, polypropylenes, polyacrylics, and combinations thereof, and wherein the polymeric hindered amine compound is selected from the group consisting of (i) a copolymer of N,N-bis-(2,2,6,6-tetramethyl-piperidin-4-yl)-propane-1,3-diamine, N,N-bis-(2,2,6,6-tetramethyl-piperidin-4-yl)-hexane-1,6-diamine, and N-butyl-2,2,6,6-tetramethylpiperidin-4-amine, (ii) a copolymer of N-butyl-2,2,6,6-tetramethylpiperidin-4-amine, $N^1$-(2,2,6,6-tetramethyl-piperidin-4-yl)-hexane-1,6-diamine, and 2,4,6-trichloro-[1,3,5]triazine, (iii) a copolymer or homopolymer of 2,2,6,6-tetramethyl-piperidin-4-yl methacrylate, (iv) a copolymer of 2,2,6,6,-tetramethyl-piperidin-4-amine, maleic anhydride, and $C_{20}$-$C_{24}$ alkenes, (v) poly[(6-morpholino-s-triazine-2,4-diyl)[(2,2,6,6-tetramethyl-piperidin -4-yl) imino]-hexamethylene [(2,2,6,6-tetramethyl-piperidin-4-yl) imino)]], (vi) a copolymer of N,N-bis-(2,2,6,6-tetramethyl-piperidin-4-yl)-hexane-1,6-diamine, 2,4,6-trichloro-[1,3,5]triazine, and N-butyl-1-butanamine, (vii) poly[(6-((1,1,3,3-tetramethylbutyl)amino)-1,3,5-triazine-2,4-diyl)((2,2,6,6-tetramethyl -piperidin-4-yl)imino)-1,6-hexanediyl ((2,2,6,6-tetramethyl-4-piperidinyl)imino)], (viii) a copolymer of N,N-bis-(2,2,6,6-tetramethyl-piperidin-4-yl)-hexane-1,6-diamine, 2,4,6-trichloro-[1,3,5]triazine, and 2,4,4-trimethyl-1,2-pentanamine, (ix) a copolymer of N,N-bis-(2,2,6,6-tetramethyl-piperidin-4-yl)-hexane-1,6-diamine and morpholine-2,4,6-trichloro-[1,3,5]triazine, and (x) combinations thereof.

10. The treated textile material of claim 9, wherein the halogen is chlorine.

* * * * *